US008443928B2

(12) United States Patent
Chang

(10) Patent No.: US 8,443,928 B2
(45) Date of Patent: May 21, 2013

(54) EXHAUST TAIL PIPE

(75) Inventor: Chin-Chuan Chang, Changhua Hsien (TW)

(73) Assignee: Liang Fei Industry Co., Ltd., Changhua Hsien (TW)

( * ) Notice: Subject to any disclaimer, the term of this patent is extended or adjusted under 35 U.S.C. 154(b) by 264 days.

(21) Appl. No.: 12/926,686

(22) Filed: Dec. 3, 2010

(65) Prior Publication Data

US 2012/0138378 A1 Jun. 7, 2012

(51) Int. Cl.
*F16L 25/04* (2006.01)
*E21B 17/042* (2006.01)

(52) U.S. Cl.
CPC ..... *E21B 17/042* (2013.01)
USPC ..... 180/309; 29/890.08; 285/334.2; 181/228

(58) Field of Classification Search
USPC ..... 180/309; 29/890.8, 890.08; 285/334.2; 181/228
See application file for complete search history.

(56) References Cited

U.S. PATENT DOCUMENTS

| | | | | |
|---|---|---|---|---|
| 6,343,673 | B1 * | 2/2002 | Chang | 181/227 |
| 6,491,418 | B1 * | 12/2002 | Chen | 362/487 |
| 6,595,318 | B2 * | 7/2003 | Ebinger et al. | 181/227 |
| 6,910,793 | B1 * | 6/2005 | Shuen | 362/545 |
| 7,464,464 | B2 * | 12/2008 | Neef | 29/890.08 |
| 2005/0061571 | A1 * | 3/2005 | Chen | 180/309 |

* cited by examiner

*Primary Examiner* — J. Allen Shriver, II
*Assistant Examiner* — Brian Cassidy
(74) *Attorney, Agent, or Firm* — Guice Patents PLLC

(57) ABSTRACT

An exhaust tail pipe includes a front outer tube, an inner tube and a rear tail pipe. The inner tube has a plurality of screw holes on one side mating a plurality of apertures formed on a rear coupling portion of the front outer tube to be fastened together by a plurality of bolts. The rear coupling portion is coupled on the front end of the rear tail pipe so that the rear section of the inner tube is held at the rear end of the rear tail pipe and fastened together by welding. Such a structure allows the front outer tube and rear tail pipe to be made of different materials, thus can maintain aesthetic appeal of the appearance to enhance product value.

7 Claims, 5 Drawing Sheets

EXHAUST TAIL PIPE

BACKGROUND OF THE INVENTION

1. Field of the Invention

The present invention relates to an exhaust tail pipe and particular to an improved exhaust tail pipe comprising of various materials formable in multiple combinations to maintain aesthetic appeal and enhance product value.

2. Description of the Prior Art

A conventional exhaust tail pipe 1, referring to FIG. 1, includes an outer tube 11 coupled an inner tube 12 inside with connecting junctions A and B of various elements formed by welding. To meet welding requirement, the choice of material selection is limited, and no much alteration of outside appearance of the exhaust tail pipe can be made.

Another type of conventional exhaust tail pipe 2, referring to FIG. 2, includes a rear outer tube 21 with a front side fastened to a front tail pipe 22 through rivets D. While such a structure offers advantage of diversified material selections without the limitation occurred to welding, the jutting rivets D spoil the appeal of total appearance.

How to overcome the problems of the conventional exhaust tail pipes that either have limitation on material selection or aesthetic concern in appearance is an issue remained to be overcome in the industry.

SUMMARY OF THE INVENTION

Therefore the present invention aims to provide an improved exhaust tail pipe that can be made of various materials and formed in multiple combinations to maintain aesthetic appeal and enhance product value.

To achieve the foregoing object the exhaust tail pipe according to the invention includes a front outer tube, an inner tube and a rear tail pipe. The inner tube has a plurality of screw holes on one side mating a plurality of apertures formed on a rear coupling portion of the front outer tube to be fastened together by a plurality of bolts. The rear tail pipe is coupled on a rear end of the front outer tube so that the inner tube has its rear section located at the rear end of the rear tail pipe to be welded together. Such a structure allows the front outer tube and rear tail pipe to be made of various materials and also maintains aesthetic appeal of the appearance to enhance product value.

The foregoing, as well as additional objects, features and advantages of the invention will be more readily apparent from the following detailed description, which proceeds with reference to the accompanying drawings.

DESCRIPTION OF THE PREFERRED EMBODIMENT

Figure 1:
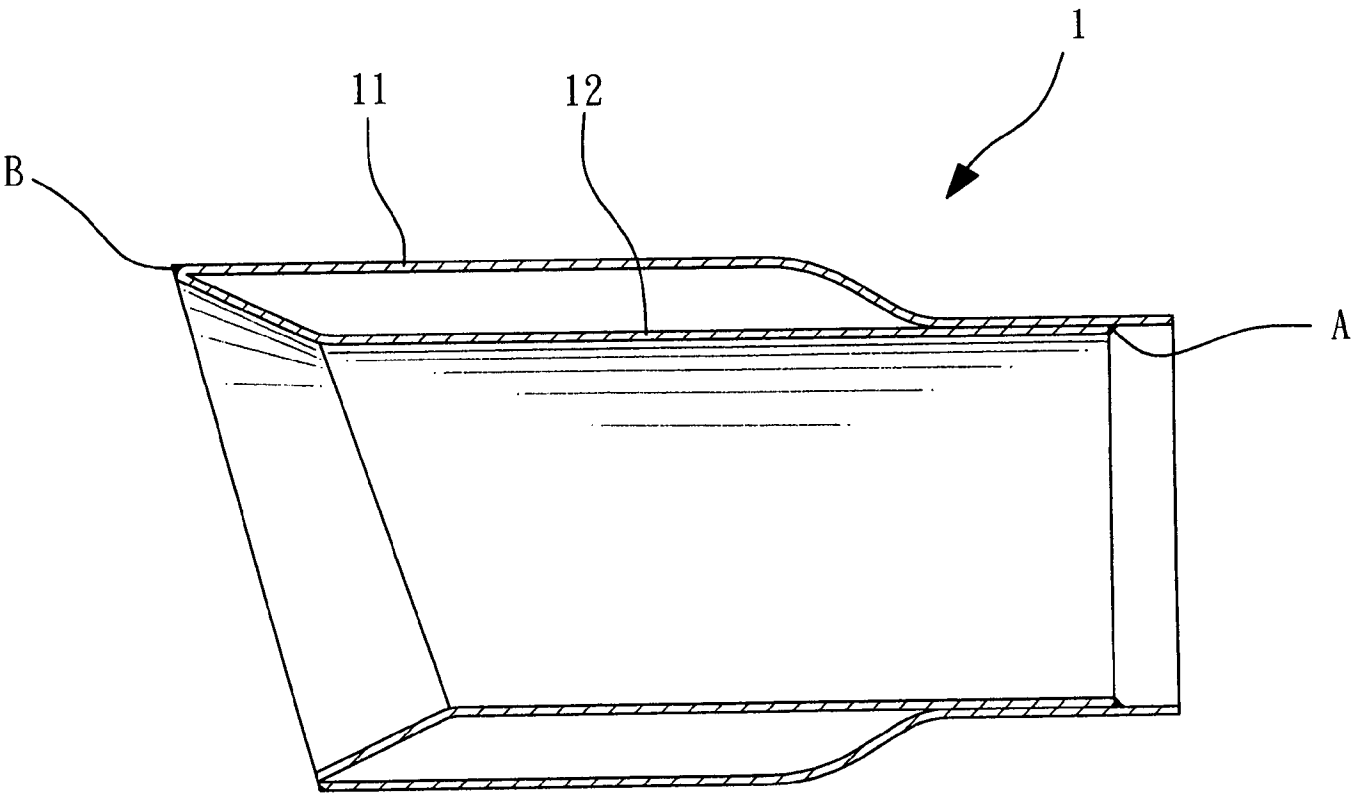
FIG. 1 PRIOR ART
FIG. 1 is a schematic view of the structure of a conventional exhaust tail pipe.
Figure 2:
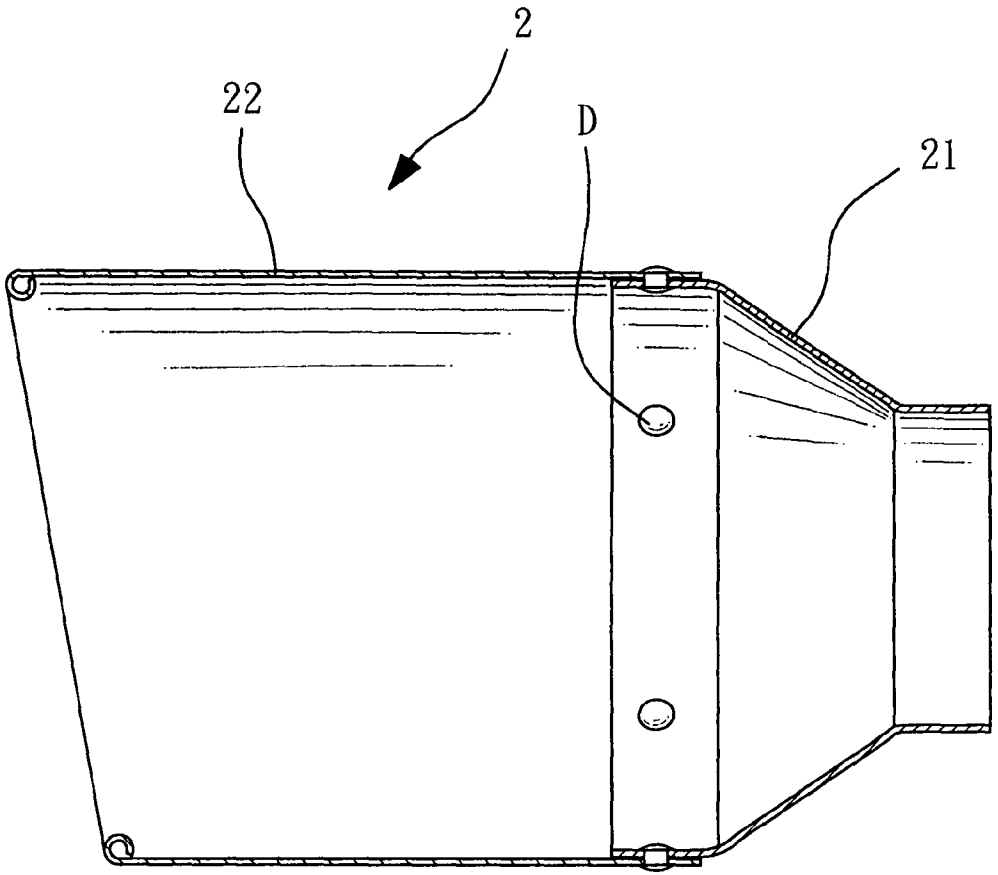
FIG. 2 PRIOR ART
FIG. 2 is a schematic view of the structure of another conventional exhaust tail pipe.
Figure 3:
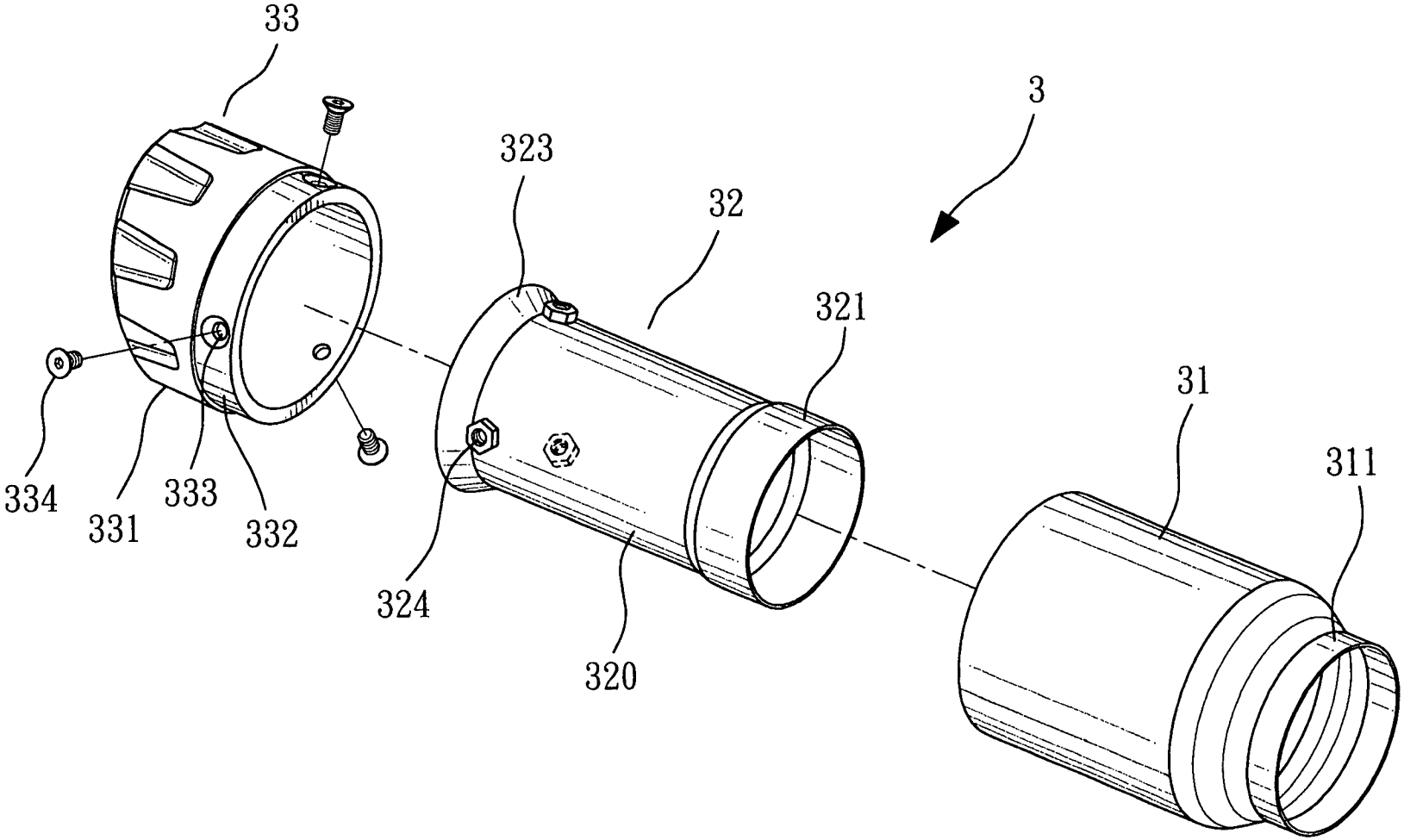
FIG. 3 is an exploded view of the invention.
Figure 4:
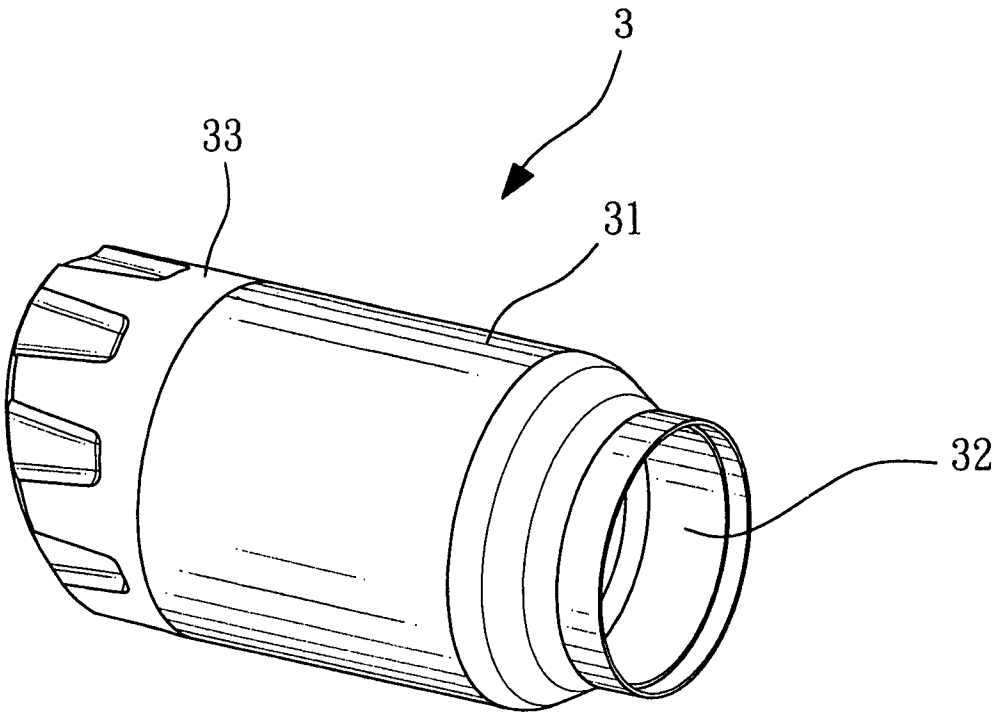
FIG. 4 is a perspective view of the invention.
Figure 5:
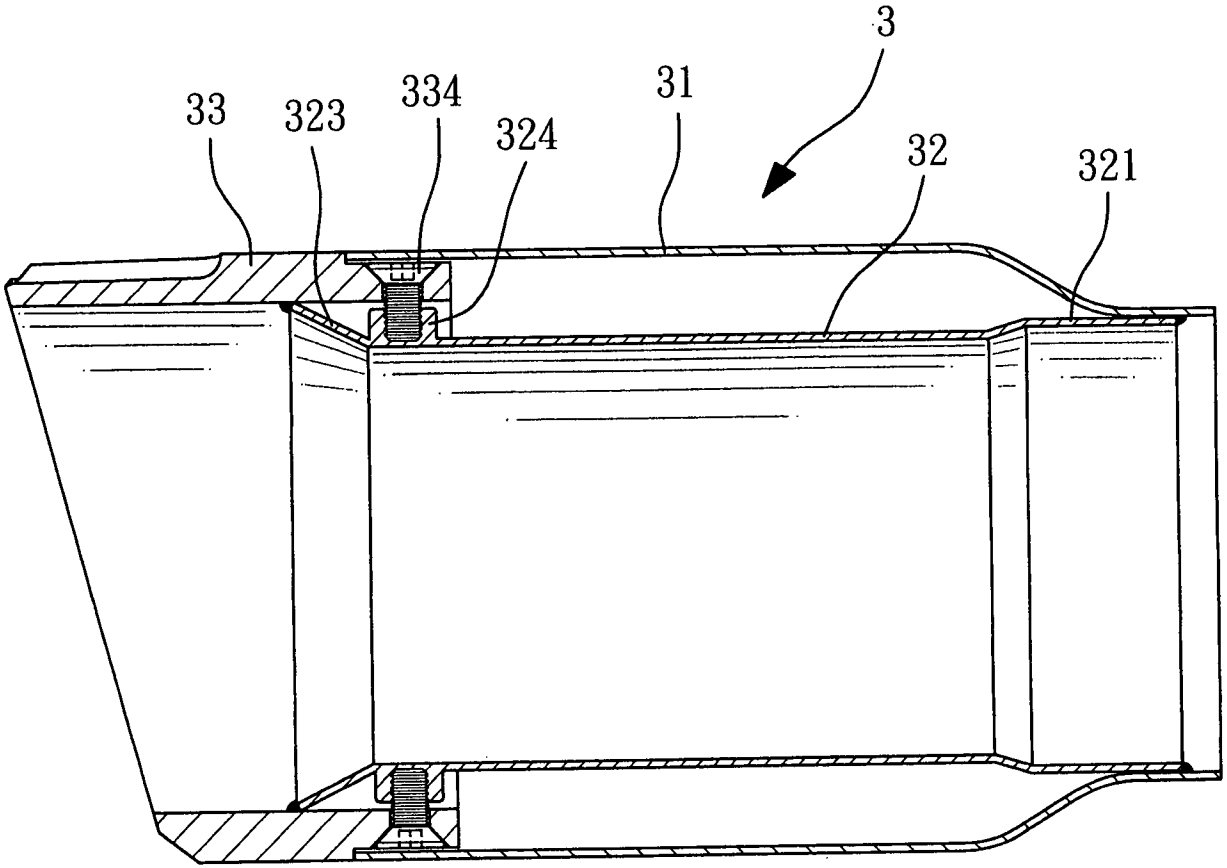
FIG. 5 is a sectional view of the invention.

Please referring to FIG. 3, the present invention aims to provide an improved exhaust tail pipe 3 that comprises a rear tail pipe 31, an inner tube 32 and a front outer tube 33 (also referring to FIGS. 4 and 5).

The rear tail pipe 31 is a hollow tube and has a rear end 311 at one side shrunk at a smaller diameter than another side of the rear tail pipe 31.

The inner tube 32 is a hollow and held in the rear tail pipe 31, and has a rear section 321 coupled with the inner wall of the rear end 311 of the rear tail pipe 31 by welding. The inner tube 32 includes a body 320 with a front side formed a plurality of fastening screw holes 324 and an expanded portion 323 formed at a larger diameter.

The front outer tube 33 is hollow and has a tubular part 331 with a rear end formed a rear connecting portion 332 inserted between the rear tail pipe 31 and inner tube 32. The rear connecting portion 332 has a plurality of apertures 333 mating the fastening screw holes 324 to be fastened by a plurality of bolts 334.

By means of the elements set forth above, for assembly, first, couple the front outer tube 33 on one side of the inner tube 32 with the apertures 333 mating the fastening screw holes 324, then fasten them together with the bolts 334; next, place the inner tube 32 in the rear tail pipe 31 to couple the rear section 321 of the inner tube 32 with the inner wall of the rear end 311 of the rear tail pipe 31, and weld them together. Thus the rear connecting portion 332 of the front outer tube 33 is inserted between the rear tail pipe 31 and the inner tube 32, and the expanded portion 323 of the inner tube 32 insert into the inner wall of the front outer tube 33 to form secure bracing to become the finished exhaust tail pipe 3.

The front outer tube 33 and the rear tail pipe 31 are made of different materials.

As a conclusion, the invention of the rear tail pipe can select from various materials (such as titanium, aluminum or the like) and combining different materials without welding. Overall aesthetic appeal of the exhaust tail pipe can be maintained intact and product value can be enhanced. It provides a significant improvement over the conventional techniques.

I claim:

1. An exhaust tail pipe comprising:

a rear tail pipe, an inner tube, and a front outer tube;

wherein the rear tail pipe being hollow and having a front end and a rear end;

wherein the inner tube being hollow and having a front end and a rear end, the inner tube is located in an interior of the rear tail pipe and an interior of the front outer tube, the inner tube has a rear section of the rear end thereof connected to an interior surface of the rear end of the rear tail pipe by welding and a plurality of fastening screw holes located in a front section of the front end thereof; and wherein the front outer tube being hollow and having a front end and a rear end; the front outer tube has a tubular part located on the front end thereof and a rear connecting portion located on the rear end thereof, the rear connecting portion is located between the rear tail pipe and the inner tube, the rear connecting portion has a plurality of apertures corresponding with the plurality of fastening screw holes located in the front section of the front end of the inner tube, the rear connecting portion of the front outer tube is connected to the front section of the front end of the inner tube.

2. The exhaust tail pipe of claim 1, the rear connecting portion of the front outer tube is connected to the front section of the front end of the inner tube by a plurality of bolts inserted through the plurality of apertures of the front outer tube and connected to the plurality of fastening screw holes of the inner tube.

3. The exhaust tail pipe of claim 2, wherein the plurality of bolts are covered by the front end of the rear tail pipe.

4. The exhaust tail pipe of claim 1, wherein the front outer tube and the rear tail pipe are made of different materials.

5. The exhaust tail pipe of claim 1, wherein the inner tube has an expanded portion located on the front end thereof and extending outwards.

6. The exhaust tail pipe of claim 5, wherein the expanded portion of the inner tube is connected to an interior surface of a middle section of the front outer tube, the middle section of the front outer tube is located between the front end and the rear end of the front outer tube.

7. The exhaust tail pipe of claim 1, wherein the rear end of the rear tail pipe has a diameter that is smaller than a diameter of the front end of the rear tail pipe.

* * * * *